US008132524B2

(12) United States Patent
Pereira

(10) Patent No.: US 8,132,524 B2
(45) **Date of Patent: *Mar. 13, 2012**

(54) PERSONAL WATERCRAFT WITH REACTIVE SUSPENSION AND AN INTEGRATED BRAKING AND STEERING SYSTEM

(76) Inventor: Fred Pereira, Las Vegas, NV (US)

( * ) Notice: Subject to any disclaimer, the term of this patent is extended or adjusted under 35 U.S.C. 154(b) by 4 days.

This patent is subject to a terminal disclaimer.

(21) Appl. No.: 12/592,905

(22) Filed: Dec. 3, 2009

(65) Prior Publication Data

US 2010/0132602 A1 Jun. 3, 2010

Related U.S. Application Data

(60) Provisional application No. 61/200,682, filed on Dec. 3, 2008.

(51) Int. Cl.
*B63B 1/22* (2006.01)

(52) U.S. Cl. ..... 114/284

(58) Field of Classification Search ..... 114/284
See application file for complete search history.

(56) References Cited

U.S. PATENT DOCUMENTS

| | | | | |
|---|---|---|---|---|
| 4,351,262 | A * | 9/1982 | Matthews | 114/284 |
| 5,603,281 | A * | 2/1997 | Harvey et al. | 114/363 |
| 6,620,003 | B2 * | 9/2003 | Mardikian | 440/38 |
| 2010/0132603 | A1 * | 6/2010 | Pereira | 114/55.54 |
| 2010/0138084 | A1 * | 6/2010 | Pereira | 114/363 |

* cited by examiner

*Primary Examiner* — Stephen Avila

(57) ABSTRACT

A watercraft with several stability and handling design improvements. It has an enhanced reactive suspension system positioned in the vessel between a set of separating hull and body components. The watercraft also has improved braking, steering and stabilizing systems designed around multiple pivoting mechanisms on the vessel hull that work individually or in unison to achieve the desired braking or steering effect. The stabilizing system is operated by a computerized, gyroscopic hydraulic control to maintain stability and comfort of ride, minimizing the roll, pitch and yaw commonly experienced in the passenger compartment.

13 Claims, 10 Drawing Sheets

R
2

2 9

PERSONAL WATERCRAFT WITH REACTIVE SUSPENSION AND AN INTEGRATED BRAKING AND STEERING SYSTEM

Applicant claims priority of U.S. Provisional Patent Application Ser. No. 61/200,682 entitled "Watercraft Stabilization System", filed Dec. 3, 2008, and incorporates by reference all material therein.

BACKGROUND OF THE INVENTION

The present invention relates to a personal watercraft (PWC) with an improved stabilizing system adapted to ensure that a smooth ride is experienced in the passenger compartment and seat. More particularly, to a water vessel designed to provide, stability, comfort as well as enhanced performance and safety.

Heretofore, because of the inherent jostling of a water vessel motorized water-sports such as boating have been for those who are not prone to motion sickness or have back disorders. This new invention utilizes and combines known and new technologies in a unique and novel configuration to overcome the aforementioned "jostling" problems and accomplish this.

SUMMARY OF THE INVENTION

The general purpose of the present invention, which will be described subsequently in greater detail, is to provide a PWC with an enhanced suspension system that is able to stabilize the passenger compartment or seating area with respect to the motion of the hull assembly and provide a level of comfort and minimized motion heretofore unknown in the water sport industry. This watercraft has many of the advantages mentioned heretofore and many novel features that result in a new which is not anticipated, rendered obvious, suggested, or even implied by any of the prior art, either alone or in any combination thereof.

An object of the present invention is to provide an improved watercraft suspension system that connects and resides between the vessel hull and vessel body and in conjunction with the stabilizing system is capable of dramatically reducing the roll, pitch and yaw of the passenger compartment.

It is another object of this invention to provide a watercraft with an improved steering and braking system capable of meeting or exceeding all known standards for watercraft handling.

It is a further object of this invention to provide a watercraft adapted for use by persons prone to discomfort or injury as a result of excessive roll, pitch or yaw motions imparted to their bodies.

It is yet a further object of this invention to provide a watercraft with enhanced handling characteristics.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
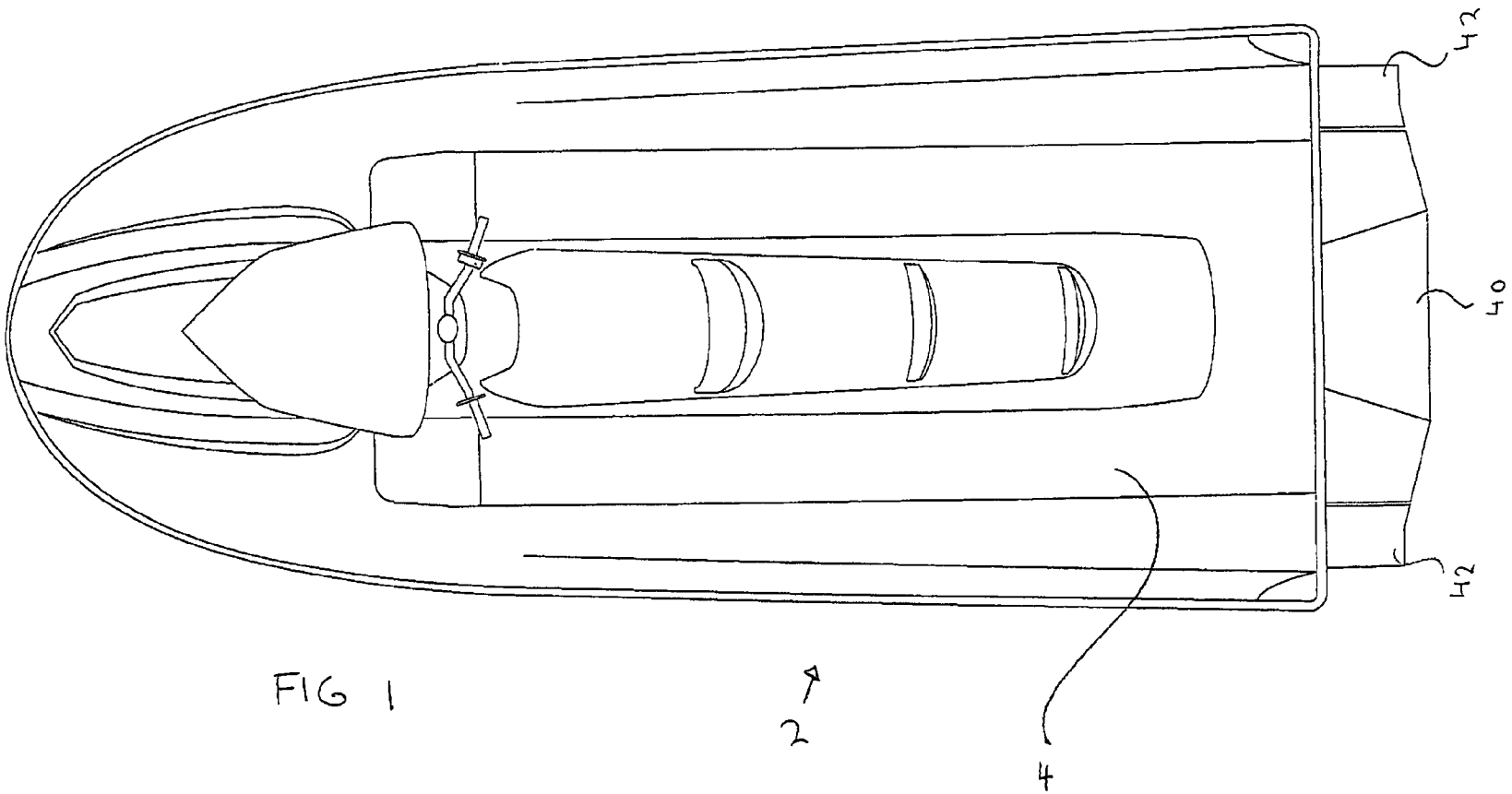
FIG. 1 is a top view of the improved PWC.
Figure 2:
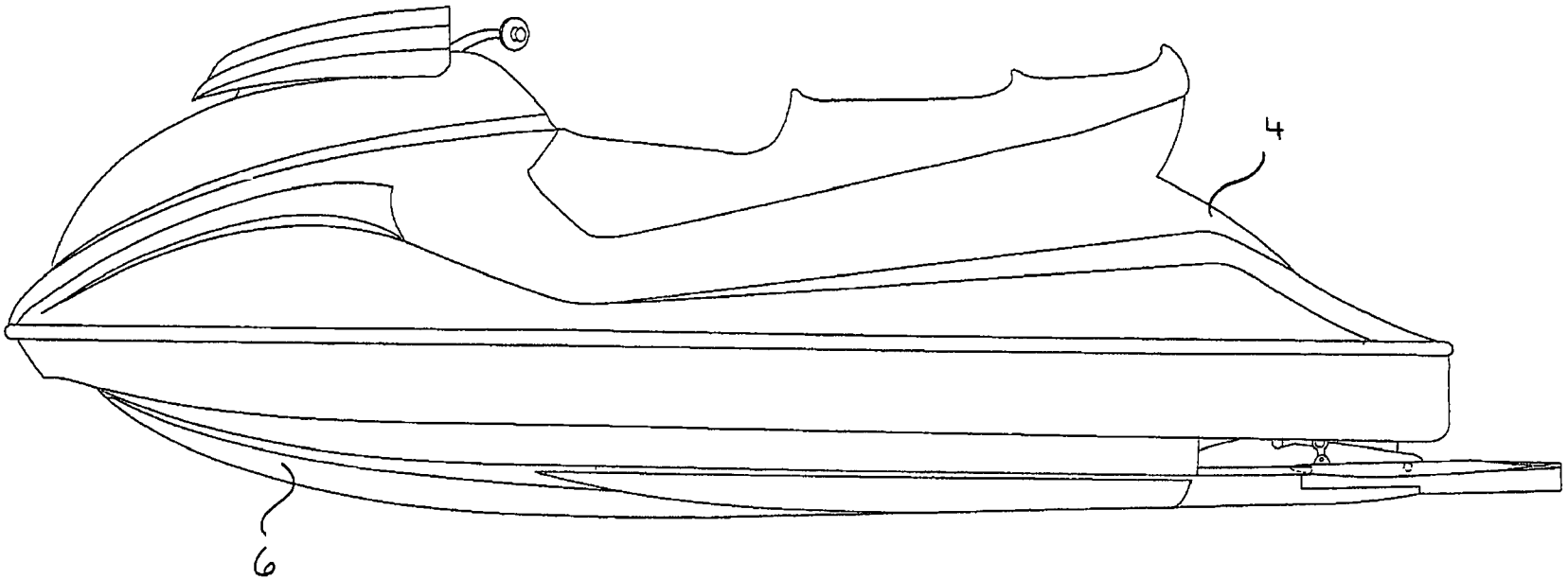
FIG. 2 is a side view of the improved PWC.
Figure 3:
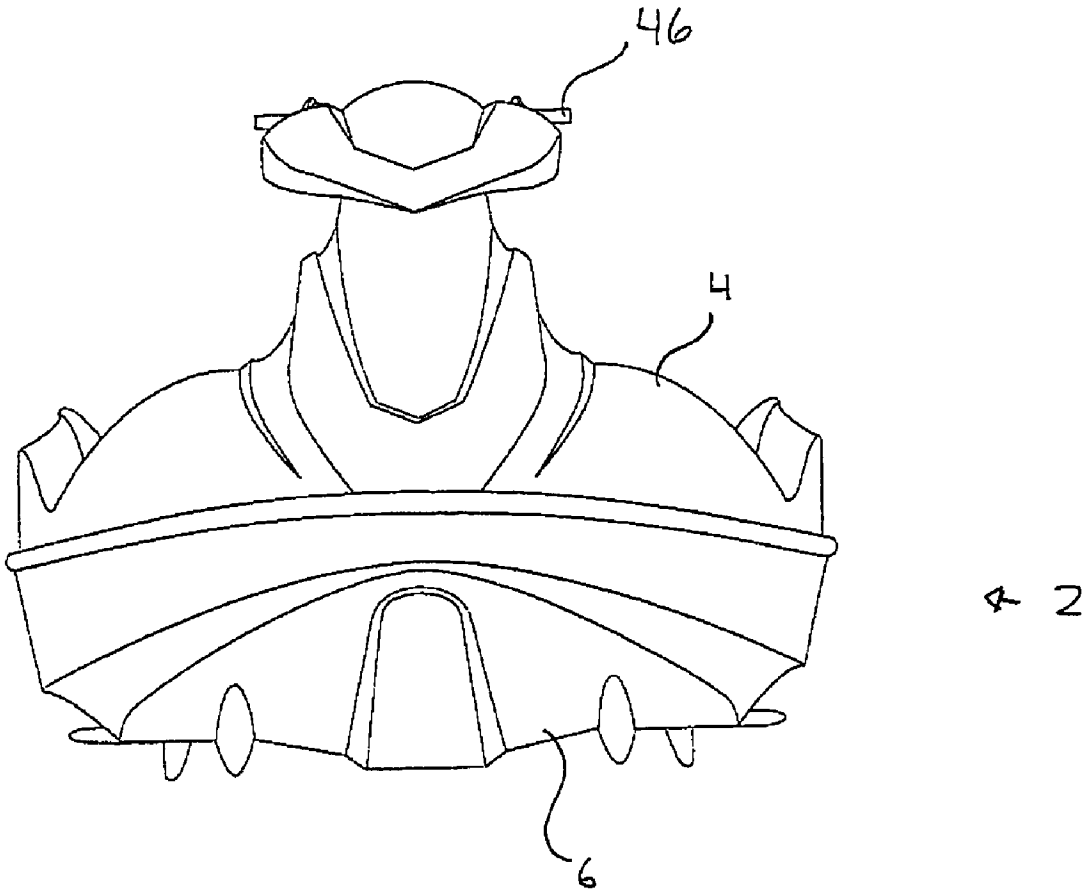
FIG. 3 is a front view of the improved PWC.
Figure 4:
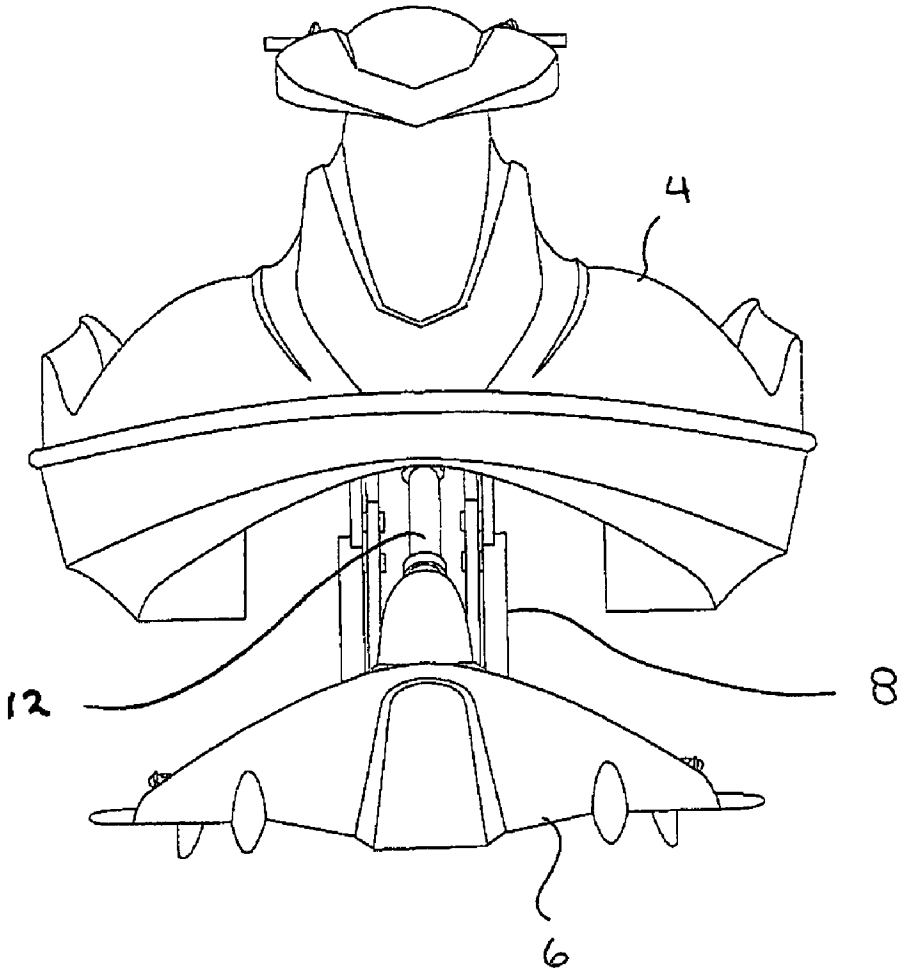
FIG. 4 is a front view of the improved PWC in the elevated position.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. Looking at FIGS. 1, 2, 3 and 4 it can be seen that the present invention entails a PWC 2 that is made of a body/upper hull section 4 that is operatively connected to a propulsion/lower hull section 6 by an extendible suspension system 8 that has a central lift shock tube (shock absorber) 12 that may be extended upward pneumatically or hydraulically so as to separate the body/upper hull section 4 upwardly from and slightly behind the lower hull section 6.

It also has a steering system, a braking system and a stabilizing system that may work independently or in unison. These three systems commonly share a set of three hydraulic operated flaps (two elevons 42 and one elevator 40) that may be manipulated by manual or automatic control.

Figure 5:
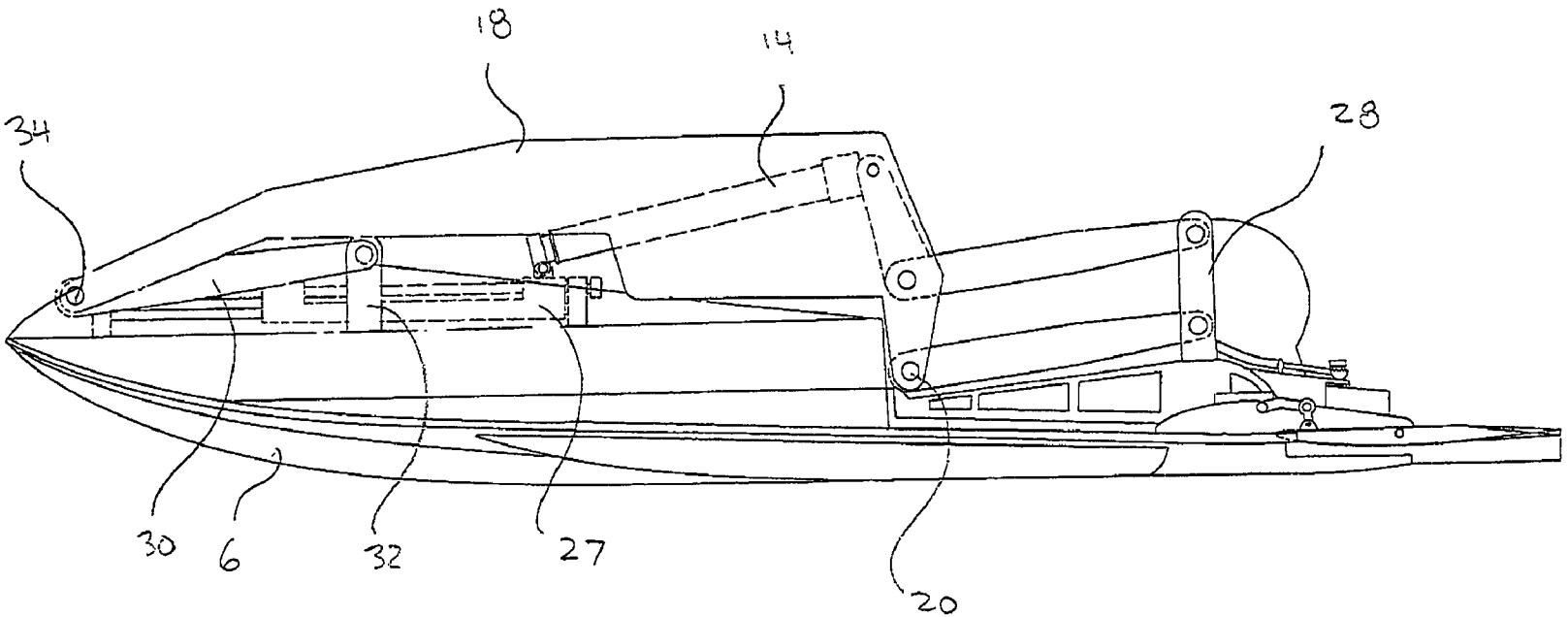
FIG. 5 is a cross sectional side view of the improved PWC with the body section removed and in the contracted position.
Figure 6:
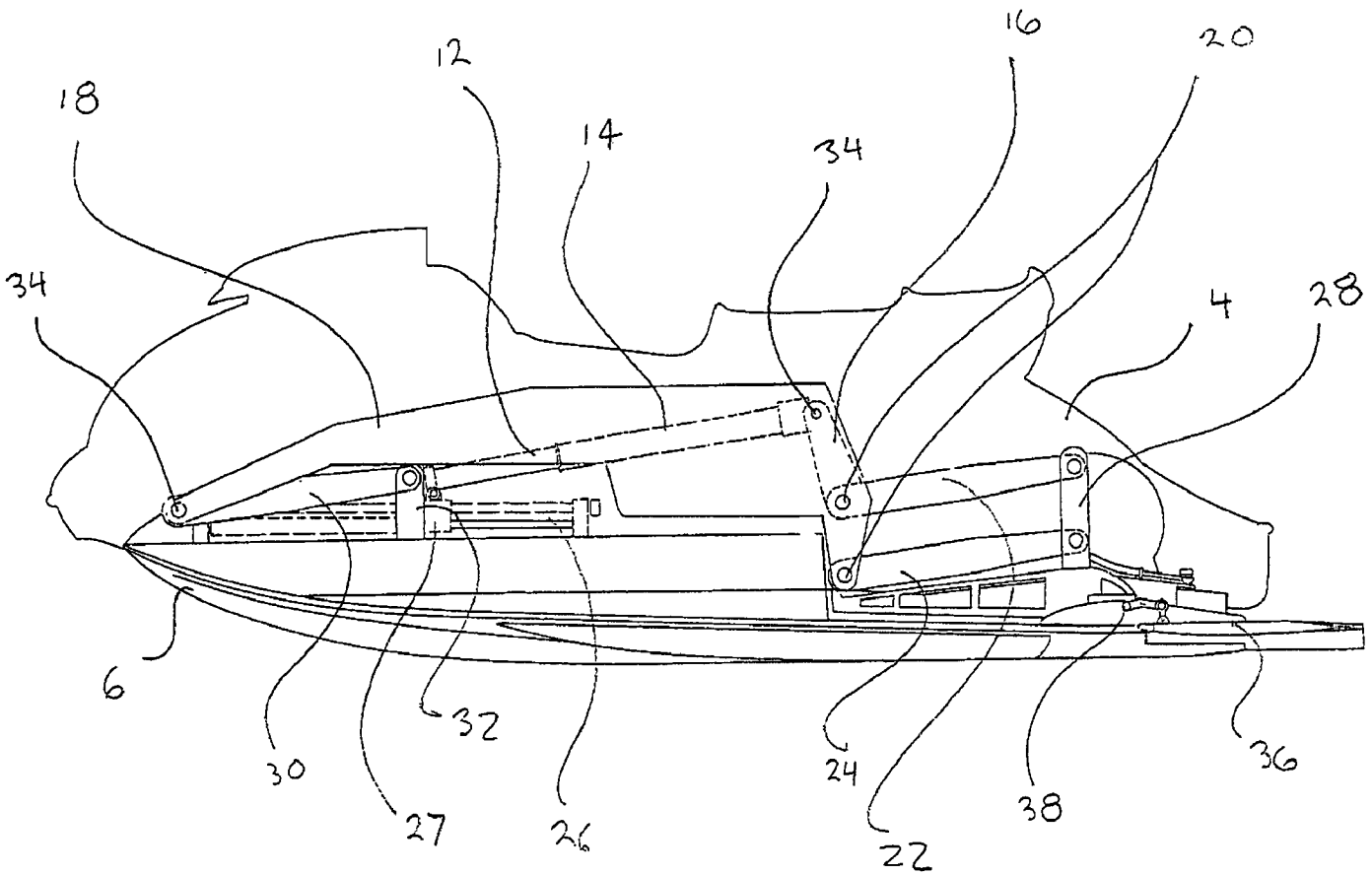
FIG. 6 is a phantom representation of the improved PWC with the body section installed and in the contracted position.
Figure 7:
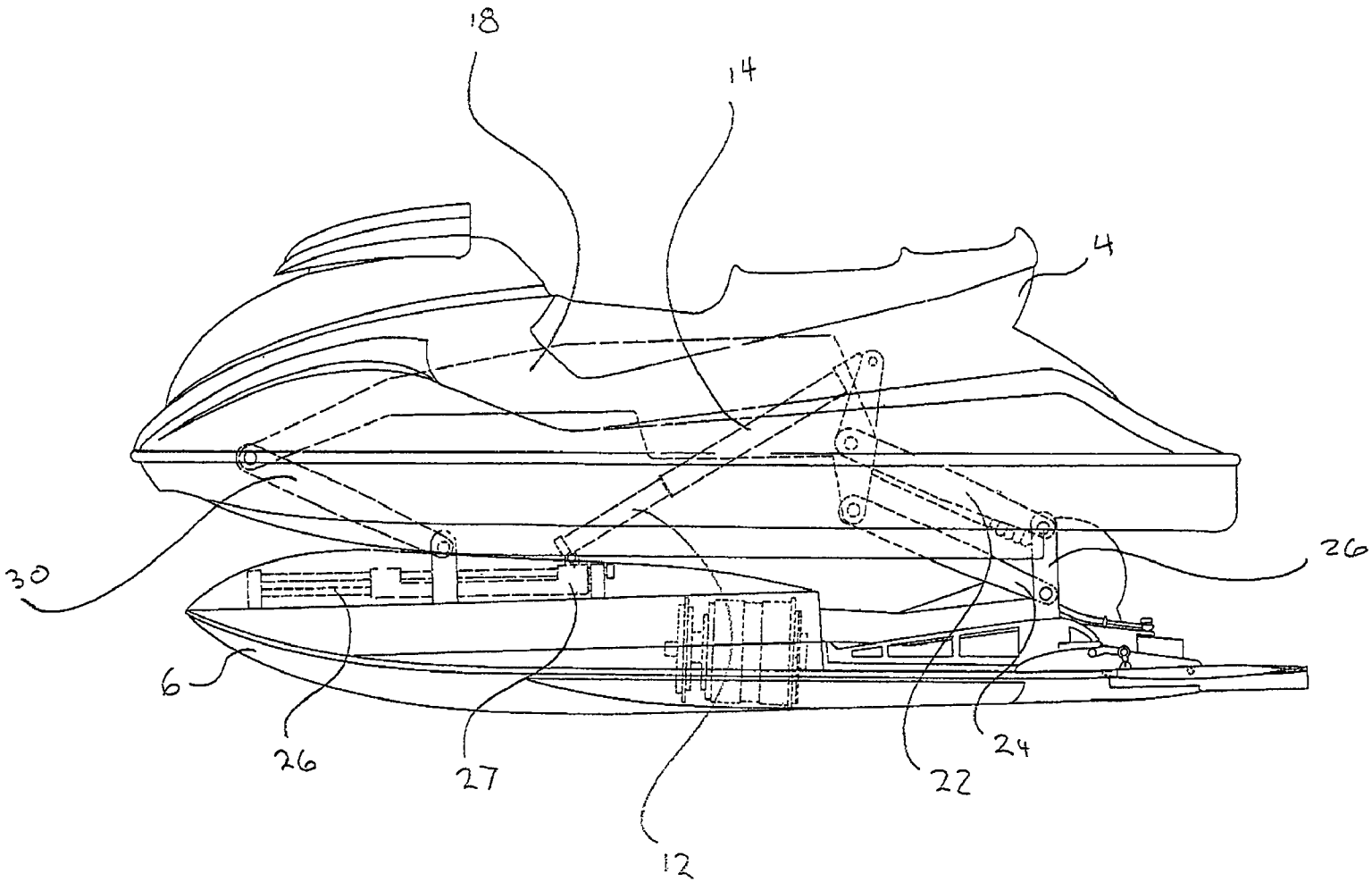
FIG. 7 is a cross sectional side view of the improved PWC in the elevated position.
Figure 8:
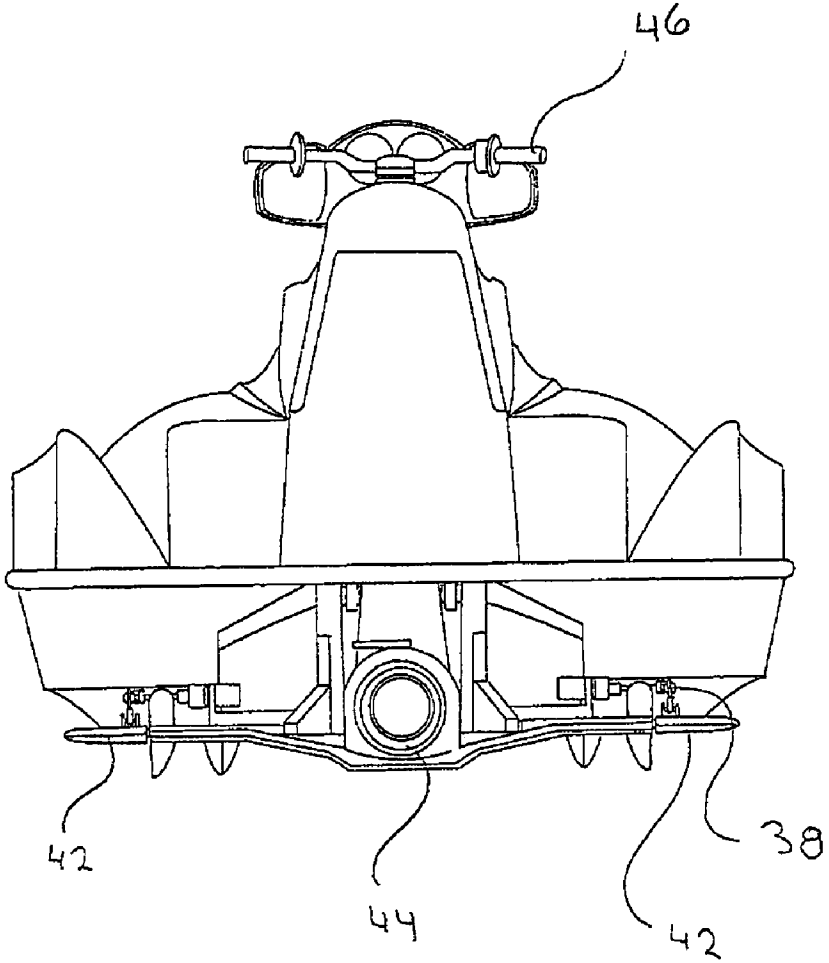
FIG. 8 is a rear view of the improved PWC.
Figure 9:
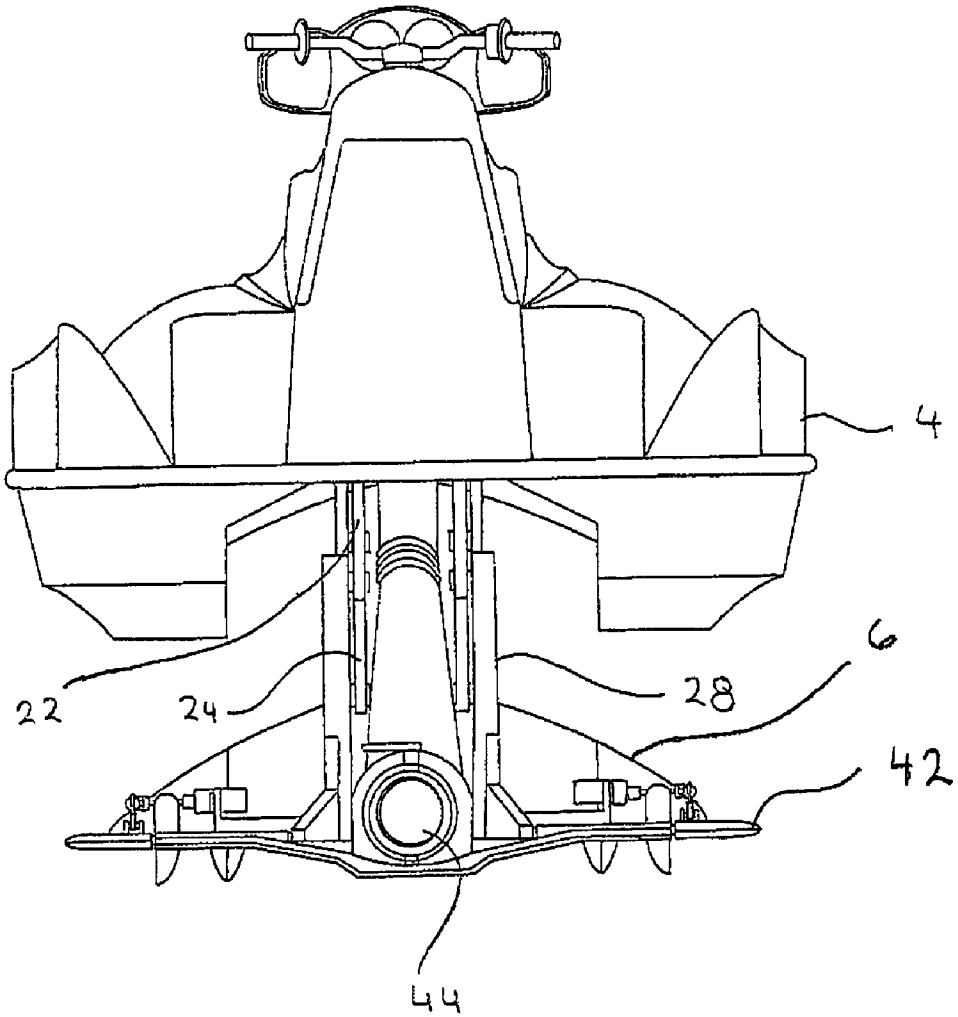
FIG. 9 is a rear view of the improved PWC in the elevated position.

Looking at FIGS. 5, 6 and 7, phantom representations of the improved PWC 2 with the body section in the contracted position and elevated position, it can be seen that body/upper hull section 4 may be extended or raised above the lower hull section 6. This extension is done pneumatically by the addition of pressurized air into central lift shock tube 12 by a pneumatic control unit. Such pneumatic control units are generally comprised of a compressor, a tank, a pressure gauge, and an actuator and have been well known in the industry for years and the details of their operation and the specific configuration and selection of their integral components do not comprise part of the present invention. For visual clarity the pneumatic control unit has been eliminated from the figures.

The admission of air into the central lift shock tube 12 is done via manual control. The central lift shock tube 12 has its front end pivotally connected to a lower sub-frame 26 which is securely mounted to the lower hull section 6, and it has its rear end pivotally connected to a pivot linkage system. This pivot linkage system pivotally connects the rear end of the shock tube 14 by an upper axle 34 to a pair of parallel pivot swing-arms 16. This causes the extension of upper tube end 14 so as to push on the top end of the pair of pivot swing-arms 16 so as to tilt the swing-arms 16 rearward and upward. Each of the pivot swing-arms 16 are pivotally connected to an upper sub-frame 18 by a pair of pivot members 20. At these same pivot connections on each of the pivot swing-arms 16 there are also pivotal connection to the first end of an upper lift arm 22 and the first end of a parallel and substantially similar lower lift arm 24. The second ends of these upper lift arms 22 and lower lift arms 24 are pivotally connected to one of a pair of rear stanchions 28 each rigidly mounted to the rear of the lower hull section 6.

The upper sub-frame 18 is pivotally connected to the front of a pair of scissor arms 30. The rear of the scissor arms 30 are pivotally connected to front stanchions 32 each rigidly mounted closer toward the front of the lower hull section 6.

These pivotal connections on the sub-frame 18, the scissor arms 30, the upper lift arms 22, the lower lift arms 24, the pivot swing-arms 16, the front stanchions 32 and the rear stanchions 28 may be accommodated by linear axles 34 that tie the pivotal connections together between the two parallel sides or alternatively by short pivot shafts. In the latter configuration the two parallel sides are connected only by the upper axle 34 connecting the rear end of the upper lift shock tube 12 to the two pivot swing-arms 16.

As can be seen comparing FIGS. 6 and 7 as the body/upper hull section 4 is raised above the hull section 6, the body section moves slightly back with respect to the propulsion/lower hull section 6 by virtue of the operation of the scissor arms 30.

The lift shock tube 12 besides raising the body section 6, acts as a pneumatic shock absorber to somewhat dampen the pitch of the PWC as waves pass along the longitudinal axis of the PWC.

The advantage of the ability of the PWC to raise its body/upper hull section 4 above its propulsion/lower hull section 6 is to allow a suspension system to be placed between the two PWC halves, to absorb high impact G forces, and a stabilization system capable of reducing the roll, pitch and yaw of the PWC.

Comparing and contrasting FIG. 5 and FIG. 6 it can be seen that The pivotal connection 27 at the front end of the central lift shock tube 12 is slidingly connected to the lower sub-frame 26 so as to allow for adjustment by the owner as to the amount of insertion of the lift shock tube 12 into the upper tube end 14. This adjustment allows the owner to customize the shock absorption and ride height of the PWC body/upper hull section 4 with respect to the hull 6.

When the central lift shock tube 12 is not extended, the watercraft's upper hull and lower hull are conjoined as a monolithic or unitary hull. Not departing from the scope of the present invention rather than a single centrally located lift shock tube 12, a pair of parallel, off centered lift shock tubes may be utilized.

Looking at FIGS. 6, 7, 8, 9 and 10 it can best be seen that at the rear of the PWC there are three flaps that are used to control the braking, steering and stabilization functions of the PWC. These are all mounted and pivot about a common rear axle 36 oriented perpendicular to the longitudinal axis of the PWC 2. The two elevons 42 and the elevator 40 are mounted on the axle 36 just slightly ahead of their axial center. Thus it will always take force to tilt any of the flaps' leading edges into the water. To tilt any flap further into the water will take increasing force since the surface area of each flap from its leading edge to the axis of tilt is less than the surface area from the axis of tilt to the trailing edge. As the moving water passes over the tilting flap more force acts upon the rear of the flap to try to keep the flap horizontal (or return it to a neutral position.) In this manner when under power, a rogue wave cannot grab the leading edge any flap and pivot its position normal to the plane of forward motion of the PWC, bringing the PWC 2 to an unexpected, abrupt stop.

Figure 10:
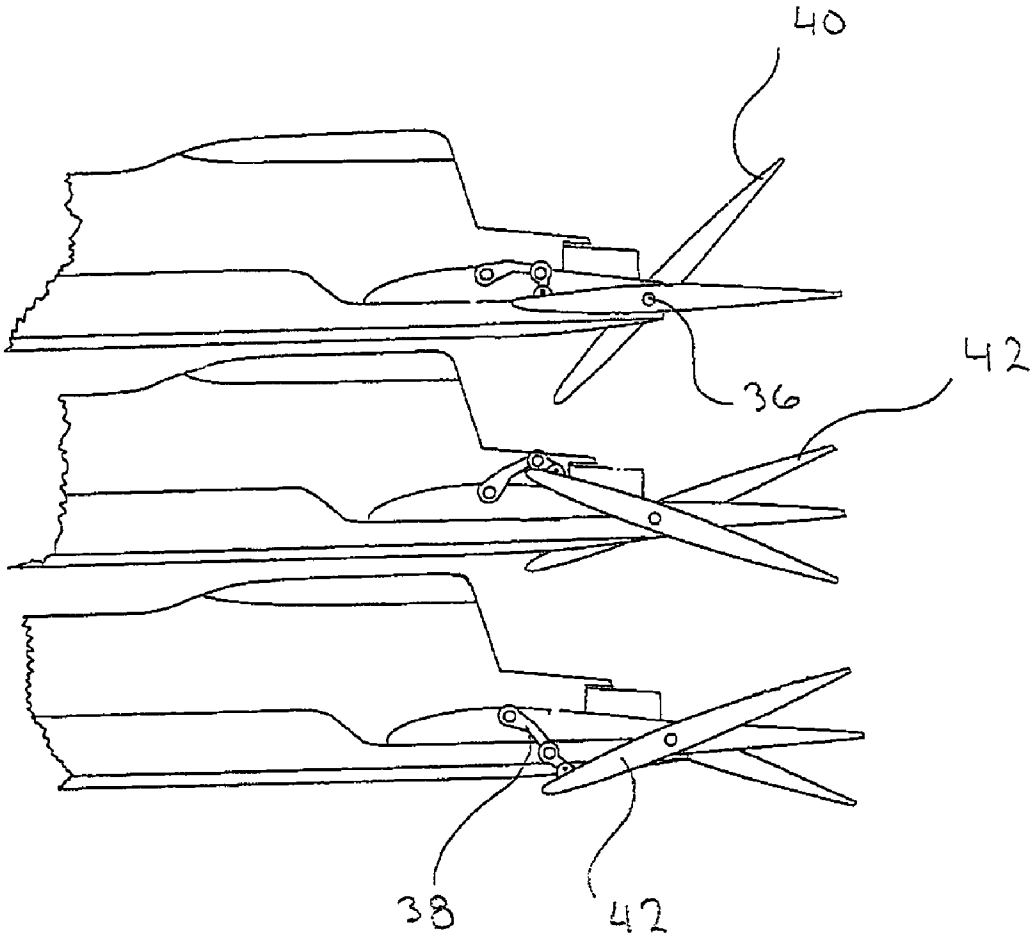
FIG. 10 is a set of three side cutaway views of the stabilization, steering and braking system of the improved PWC.

The three flaps are controlled by three devices, the handlebars 46 (for steering), the computerized gyroscope (for stability), and the brake pedal (for braking and enhanced turning.) Each of these three devices sends a signal to a hydraulic flap manipulation system. Physical movement (positioning) of the three flaps is by hydraulic manipulation although electric servo motor manipulation has been successfully tested and is an acceptable substitute that does not depart form the scope of the invention. Such positioning systems have been utilized in the mechanical field of aviation for years and the details of their operation and the specific configuration and selection of their integral components do not comprise part of the present invention. For visual clarity the hydraulic flap manipulation system has been eliminated from the figures although the flap linkage 38 can be seen in FIGS. 6 and 8 while the positioning of the flaps with their corresponding flap linkage 38 configuration can best be seen in FIG. 10. The top illustration of FIG. 10 shows the centrally located elevator 40 in a "full stop" or down position. The middle illustration of FIG. 10 shows the elevons 42 in a right turn position, and the bottom illustration of FIG. 10 shows the elevons in left turn position.

When under power, the handlebars 46 of the PWC 2 enable the turning of the jet nozzle 44 at the rear of the PWC 2 which redirects the thrust of the water pushed past the propeller/impeller to steer the PWC 2. Simultaneously, the elevons 42 both pivot (although in opposite fashion) and the elevator 40 dips slightly to frictionally engage the water surface and enhance the steering at power. The amount of movement of the elevons 42 and elevator 40 is proportional to the amount of handlebar movement.

When the engine is shut off but the PWC 2 is still moving forward, there is no thrust from the jet nozzle 44. In a conventional PWC there is a loss of the steering. (Conventional PWCs have no braking function. However, in the present invention the action of the elevons 42 and the elevator 40 in response to the handlebar 46 or brake pedal movement serve to continue the steering and braking functions, either independently or in unison.

The brake pedal controls only the position of the elevator 40. Depressing the brake pedal drives the leading edge of the elevator 40 further into the water regardless of what flap manipulations the handlebars 46 or the gyroscope are performing. The handlebars 46 counter pivot the two elevons 42 and slightly tilts the leading edge of the elevator 40. The computerized gyroscope rapidly counter pivots the two elevons 42 in relation to the roll (rotation of the PWC about its longitudinal axis) while the handlebars 46 remain within a specified number of degrees left or right of its neutral steering position. When a turn is being negotiated the handlebars 46 exceed this position and the gyroscope signal input to the hydraulic flap manipulation system is overridden.

Since the PWC has a horizontally split hull and the body/upper hull section 4 of the watercraft rises above the propulsion/lower hull portion 6, the increased PWC height enhances the motion experienced by the passengers as they are further from the axis of the roll, pitch and yaw of the passenger compartment as waves pass under the PWC 2. Under power though, the PWC's predominant motion is roll, hence the need for a stabilization system to minimize the side to side rocking. This is accomplished by a computerized gyroscopic control unit located on or adjacent a lower surface of the body/lower hull section 6 that accomplishes a fast response to minimally tilt down the leading edge of the elevon 42 on the opposite side the PWC is rocking towards and to simultaneously minimally tilt the trailing edge of the elevon 42 down on the side of the PWC is rocking toward. These elevon actions will compensate for the roll of the unit when moving under power by counteracting the side to side forces. Essentially, the stabilization system's gyroscope continually adjusts the elevons 42 when the PWC is under power and traveling in a straight line or under minimal steering (left or right movement of the handlebars) so as to maintain a level position for the body/upper hull section 4 of the PWC 2 or a stable turn, BUT when making a sharp turn (once the handlebars are moved beyond a certain position) the handlebar position overrides any gyroscope control signal. This type of enhanced steering/stabilization has heretofore not been utilized in PWCs.

Some PWC manufacturers have utilized flaps on the side of the PWC (hereinafter sponsons) to brake and steer the PWC when not under power. It is to be noted that these sponsons tilt rearward to cause drag and thus impart lift to that side of the PWC whereas when the elevon's leading edge dips into the water to direct the PWC in the same direction, it acts to suck down the PWC slightly into the water. This action of the elevon lowers the center of gravity of the PWC and minimizes the roll of the PWC whereas the roll is enhanced in the case of the sponsons.

It is to be noted that in a PWC 2, because of the physical dynamics of its design, there is no need for the computerized gyroscope to control the yaw (side to side tilting of the PWC about its longitudinal axis) and pitch (front to back tilting of the PWC about its longitudinal axis.) As such, an acceptable substitute for the computerized gyroscope would be a simple computerized tilt meter that only sends out a signal to the hydraulic flap manipulation system based on the roll component of the PWC. Computerized gyroscopic systems for the positioning of moveable means by hydraulic, pneumatic or electric actuators have been utilized in numerous mechanical fields of endeavor for years and the details of their operation and the specific configuration and selection of their integral components do not comprise part of the present invention. For visual clarity the gyroscope and or tilt meter has been eliminated from the figures. The movement of the various elements as described above is best illustrated in FIG. 10 with references to the following chart.

Positions of Steering Stabilization System Elements with Applied Function (describes the position WRT the leading edges)

| | Elevon Position | | Elevator |
|---|---|---|---|
| Applied Function | R Elevon | L Elevon | Position |
| braking (with foot pedal) | up | up | down |
| turn right (w handlebars) | down | up | min down |
| turn left (w handlebars) | up | down | min down |
| simultaneous braking & turning | see above direction | see above direction | down |
| stabilizing function (gyroscope tilt controls as PWC rolls to left) | down | up | no motion |

-continued

Positions of Steering Stabilization System Elements with Applied Function (describes the position WRT the leading edges)

| | Elevon Position | | Elevator |
|---|---|---|---|
| Applied Function | R Elevon | L Elevon | Position |
| stabilizing function (gyroscope tilt controls as PWC rolls to right) | up | down | no motion |

The ability to make the PWC 2 perform a trick maneuver is enhanced since the operator can now control the braking, the altitude of the unit and intensity of the turn, which heretofore has not been done in a PWC 2.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and described to be secured by Letters Patent is as follows:

1. An improved personal watercraft comprising:

an upper hull section housing said watercraft's operational controls and passenger seating;

a lower hull section housing a propulsion system;

a pressure actuated suspension system having at least one centrally mounted telescopic shock absorber having a distal end and a proximate end wherein said distal end of said shock absorber is slidably connected to a rigid subframe affixed to said lower hull and wherein said proximate end of said shock absorber is connected to a pivot linkage mechanism affixed at its upper end to said upper hull; and a first pressure actuation system;

wherein said first pressure actuation system is in operational connection with said tubular shock absorber so as to telescope the distance between said distal end and proximate end thereby separating or conjoining said upper hull section from said lower hull section, and wherein said distal end of said shock absorber may be adjusted to different positions in said sub frame to adjust the amount of telescopic extension of the shock absorber.

2. The improved personal watercraft of claim 1 wherein said pivot linkage mechanism has at least one swing-arm pivotally connected to said proximate end of said shock absorber and pivotally connected to at least one lift arm which is pivotally connected to at least one rear stanchion rigidly mounted onto said lower hull.

3. The improved personal watercraft of claim 2 wherein said number of swing-arms is two held in a parallel configuration on opposing sides of said proximate end of said shock absorber by a first axle, said number of lift-arms is four arranged in two pairs of parallel configurations attached to said swing-arms by a second and a third axle and wherein said number of rear stanchions is two which are attached to said swing-arms by a fourth and a fifth axle.

4. The improved personal watercraft of claim 3 further comprising;

an upper sub-frame rigidly connected to said upper hull;

a pair of front stanchions rigidly mounted to the lower hull;

a pair of pivotal scissor arms held in parallel configuration and connected at a first end to said upper sub-frame by a sixth axle and connected at a second end to said front stanchions by a seventh axle.

5. The improved personal watercraft of claim 1 wherein said pressure actuation system is a pneumatic system.

6. The improved personal watercraft of claim 1 wherein said pressure actuation system is a hydraulic system.

7. The improved personal watercraft of claim 1 further comprising:

an integrated braking and steering system of three flaps each having a leading edge and a trailing edge a pivot axle passing axially through all three flaps at a location forward of each flap's axial midline;

a second actuation system, wherein said flaps are pivotally mounted at a rear section of said lower hull, having a central elevator flap flanked by an elevon flap on either side.

8. The improved personal watercraft of claim 7 wherein said second actuation system pivotally maneuvers said three flaps leading edges vertically with respect to the horizontal axis of the watercraft to steer or brake said watercraft.

9. The improved personal watercraft of claim 8 further comprising:

a two directional level sensing control means operationally connected to said second actuation system to automatically operate said elevons in unison to stabilize said watercraft in response to a roll motion experienced by said watercraft.

10. The improved personal watercraft of claim 9 wherein said actuation system is pneumatic.

11. The improved personal watercraft of claim 9 wherein said actuation system is hydraulic.

12. The improved personal watercraft of claim 9 wherein said actuation system is a control able set of electric servo motors.

13. The improved personal watercraft of claim 9 further comprising:

a foot actuated brake pedal; and a set of handlebars, wherein said brake pedal is operationally connected to cause said elevator leading edge to move vertically without any corresponding movement of said elevons to brake said watercraft, and wherein said handlebars are operationally connected to cause said elevon leading edges to move in opposite vertical directions simultaneously and cause said elevator leading edge to move vertically downward to steer said watercraft.

* * * * *